United States Patent [19]

Solaja

[11] Patent Number: 4,809,449

[45] Date of Patent: Mar. 7, 1989

[54] LOADER ATTACHMENT

[76] Inventor: Nikola Solaja, 17 Whittle Pl., Osborne Park, Western Australia, Australia

[21] Appl. No.: 88,255

[22] Filed: Aug. 24, 1987

[30] Foreign Application Priority Data

Aug. 27, 1986 [AU] Australia ..... PH 7690

[51] Int. Cl.[4] ..... E02F 3/76

[52] U.S. Cl. ..... 37/117.5; 37/DIG. 3; 37/2 R; 172/272

[58] Field of Search ..... 37/117.5, 103, DIG. 3, 37/2 R, 2 P, 221–223, 268; 172/701.1, 445.1, 448, 451, 272, 275, 141, 199

[56] References Cited

U.S. PATENT DOCUMENTS

| | | | |
|---|---|---|---|
| 2,512,114 | 9/1946 | Robinson et al. . | |
| 2,711,036 | 2/1951 | Crenshaw | 37/2 R |
| 3,760,883 | 9/1973 | Birk | 37/231 |
| 3,876,092 | 4/1975 | MacDonald . | |
| 3,912,092 | 10/1975 | Bolton et al. | 37/117.5 |
| 4,106,645 | 8/1978 | Janish | 172/275 |
| 4,230,435 | 10/1980 | Azevedo | 414/722 |
| 4,509,768 | 4/1985 | Haug | 172/272 |
| 4,521,980 | 6/1985 | Solaja | 37/117.5 |

FOREIGN PATENT DOCUMENTS

| | | |
|---|---|---|
| 327096 | 1/1976 | Austria . |
| 0052987 | 6/1982 | European Pat. Off. . |
| 0143074 | 5/1985 | European Pat. Off. . |
| 1472685 | 5/1977 | United Kingdom . |
| 2014942 | 9/1979 | United Kingdom . |
| 2068332 | 8/1981 | United Kingdom . |

*Primary Examiner*—Eugene H. Eickholt

*Attorney, Agent, or Firm*—Laurence R. Brown; Alfred J. Mangels

[57] ABSTRACT

The present invention relates to an attachment for a loader, comprising an elongated body member generally in the form of a cylinder having a curved outer surface, a blade extending laterally of the elongated body member and projecting outwardly therefrom, and a frame attached to the curved surface of the elongated body member and being provided with at least one recessed member and at least one eye to enable the attachment to be engaged with and disengaged from a quick release mechanism of the loader, which quick release mechanism is operable from the driving position of the loader, such that when the loader is orientated in a first position the blade is arranged to engage with the ground and when the loader is orientated in a second position the curved outer surface of the body member is arranged to engage with the ground.

8 Claims, 8 Drawing Sheets

LOADER ATTACHMENT

The present invention relates to a loader attachment. In Australian Patent Application No. 29587/84 and corresponding U.S. Pat. No. 4521980 in the name of the present applicant, there is described and claimed an attachment for a loader which attachment comprises an elongated body member, a lateral slot in the body member for engagement with a bucket of a loader, and a blade extending laterally of the body member.

The attachment of U.S. Pat. No. 4,521,980 and Australian Patent Application No. 29587/84 enables the loader to perform additionally the function of a loader.

Whilst the attachment of U.S. Pat. No. 4521980 and Australian patent application No. 29587/84 has performed satisfactorily it has the disadvantage of requiring the presence of a bucket on the loader and also the disadvantage of requiring the operator to connect and disconnect the attachment to the loader by means of chains. Also, it has been found that soil tends to accumulate and become compacted underneath the bucket in use.

Many loaders are now provided with a quick release mechanism which enables a bucket to be attached to or detached from the loader quickly and efficaciously without the operator having to leave the driving position of the loader.

It has now surprisingly been discovered that the type of attachment which is the subject of U.S. Pat. No. 4521980 and Australian patent application No. 29587/84 can be improved in such manner that there is no need to rely on the presence of a bucket and the device can be arranged to take advantage of the quick release mechanism of a loader to enable the attachment to be readily attached to and detached from the loader without the operator having to leave the driving position of the loader.

In accordance with one aspect of the present invention there is provided an attachment for a loader, wherein the attachment comprises an elongated body member generally in the form of a cylinder having a curved outer surface, a blade extending laterally of the elongated body member and projecting outwardly therefrom, and frame means having a first end and a second end, said first and second ends being spaced apart from one another, the first end of the frame means being attached to the curved surface of the elongated body member and the second end of the frame means being provided with at least one recessed member and at least one eye to enable the attachment to be engaged with and disengaged from a quick release mechanism of the loader which quick release mechanism is operable from the driving position of the loader, said blade being disposed relative to the loader such that when the loader is orientated in a first position, the blade is arranged to engage with the ground upon movement of the loader and when the loader is orientated in a second position the curved outer surface of the body member is arranged to engage with the ground and to smooth the ground upon movement of the loader.

The present invention will now be described by way of example, with reference to the accompanying drawings, in which.

Figure 1:
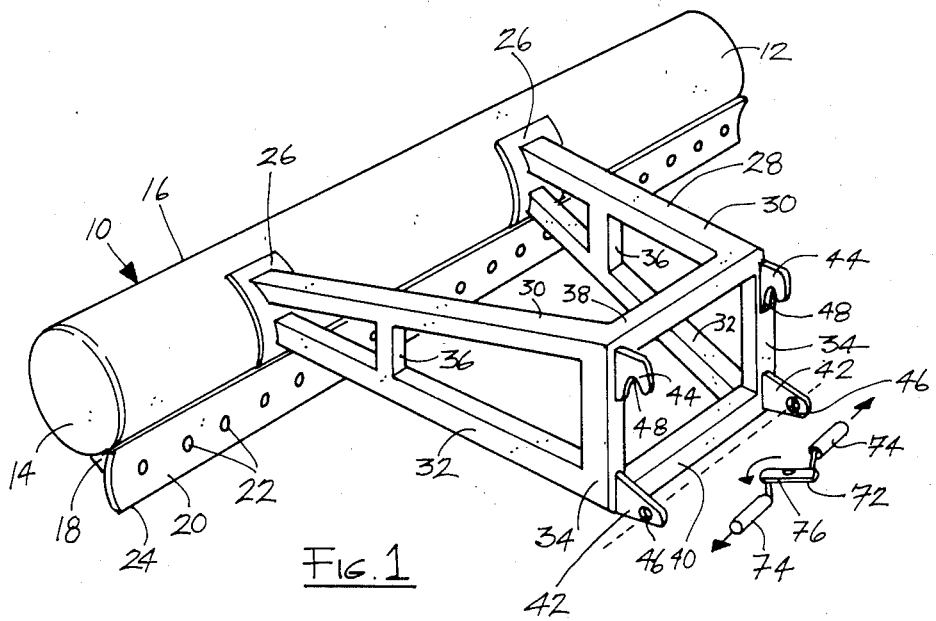
FIG. 1 is an upper perspective view of a first embodiment of loader attachment in accordance with the present invention also showing part of a quick release mechanism of a loader.
Figure 2:
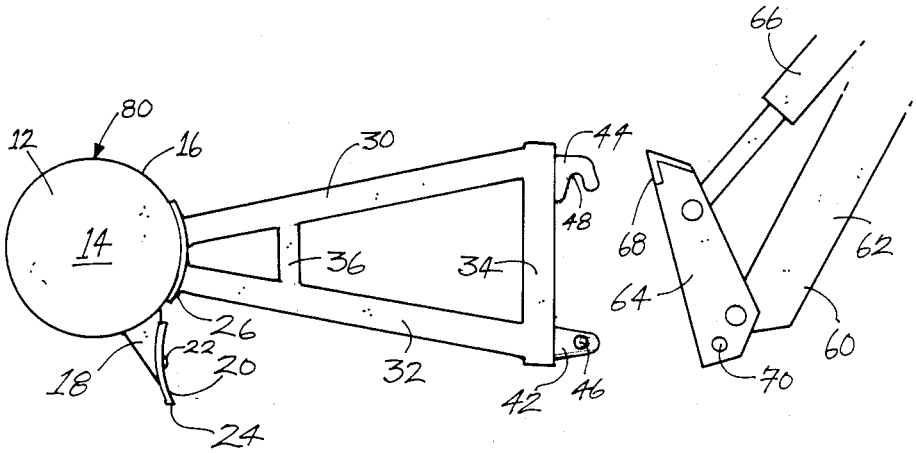
FIG. 2 is a side elevation of the attachment of FIG. 1 showing a part of a loader arranged to engage with the attachment of FIG. 1.
Figure 3:
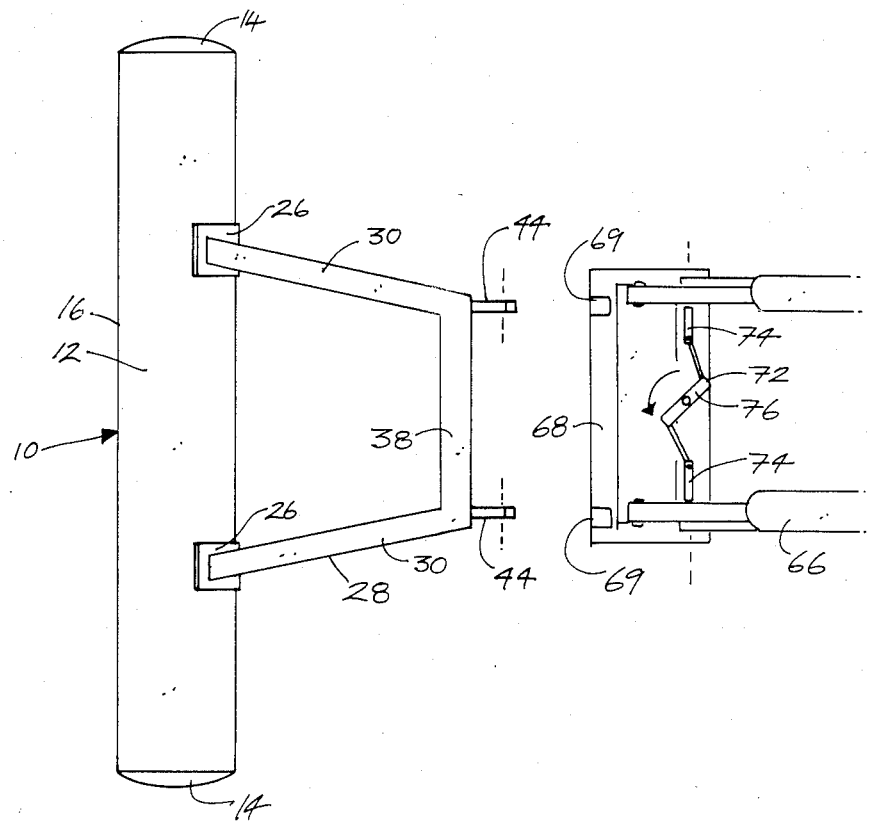
FIG. 3 is a plan view of the arrangement shown in FIG. 2.

In FIGS. 1 to 3, of the accompanying drawings, there is shown a loader attachment 10 comprising an elongated hollow generally cylindrical body member 12 with domed closed off end 14. The body member 12 has a curved outer surface 16. The loader attachment 10 comprises a generally triangular mounting member 18 welded to the curved outer surface 16. The mounting member 18 extends longitudinally of the body member 12.

Further, the mounting member 18 has an outer arcuate face which has an elongated blade member 20 mounted thereto. The blade member 20 is arcuate in transverse cross-section as can be seen in FIG. 2 and is arranged to fit snugly with the arcuate face of the mounting member 18.

The mounting member 18 contains a longitudinally extending row of threaded apertures (not shown) and the blade member 20 has a corresponding longitudinally extending row of apertures (not shown). The blade member 20 is attached to the mounting member 18 by means of threaded studs 22 with heads, said studs 22 being passed through respective holes in the blade member 20 and threadedly engaged with corresponding apertures in the mounting member 18. As can be seen in FIG. 2, the blade member 20 extends transversely beyond the mounting member 18 and has an outer grading edge 24.

A pair of curved plates 26 are welded to the curved surface 16 and are longitudinally spaced from one another. Further, the curved plates 26 are both disposed above the blade 20. A frame 28 is welded to the plates 26. The frame 28 has a first-end adjacent the body member 12 and a second end remote from the body member 12. The frame 28 comprises a pair of upper bars 30 extending outwardly from respective plates 26. The frame 28 also comprises a pair of lower bars 32 extending outwardly from respective plates 26. Each bar 30 overlies the corresponding bar 32 and each pair of bars 30 and 32 is interconnected at its outer end by an upright bar 34. Further, each pair of bars 30 and 32 is interconnected at an intermediate point by a spacer bar 36.

Further, as they extend away from the curved surface 16 the pairs of bars 30 and 32 converge together somewhat so that they are closer together at the second end of the frame 28 than they are at the first end of the frame 28.

At the second end of the frame 28 the bars 30 are interconnected by a lateral bar 38 and the bars 32 are interconnected by a lateral bar 40. The bars 38 and 40 are located between the upright bars 34.

Still further, each of the upright bars 34 has a lower lug 42 and an upper hook 44 welded thereto. The lugs 42 each contain an eye 46 and the hooks 44 each contain a downwardly facing recess 48.

In use, the attachment 10 is engaged with a loader by means of a quick release engagement mechanism 60 (known per se) of the loader part of which can be seen in FIGS. 1 to 3.

The engagement mechanism 60 includes a pair of struts 62 pivotally connected to respective upwardly extending plates 64. The upper ends of the plates 64 are pivotally connected to respective hydraulic rams 66. An upper bifurcated member 68 extends between the plates 64. The member 68 contains recesses 69 (see FIG. 3) to receive the hooks 44.

Further, each plate 64 contains an aperture 70. Between the plates 64 a quick release mechanism 72 shown in FIG. 1 is located. The quick release mechanism 72 includes a pair of pins 74 arranged to engage with respective apertures 70 and to be extended or retracted by means of a swivelling mechanism 76 controllable from the diving position of the loader by an operator.

In use, the engagement mechanism 60 is presented to the attachment 10 in the position shown in FIG. 2 such that the recesses 69 of the member 68 engage with the hooks 44 in the recesses 48 and then the hydraulic ram 66 is retracted so that the lower ends of the plates 64 fit between the plates 42. The pins 74 are at this point retracted. The pins 74 are then moved to their extended positions at which they engage with the eyes 46 so as to firmly but releasably connect the loader to the attachment 10.

Figure 4:
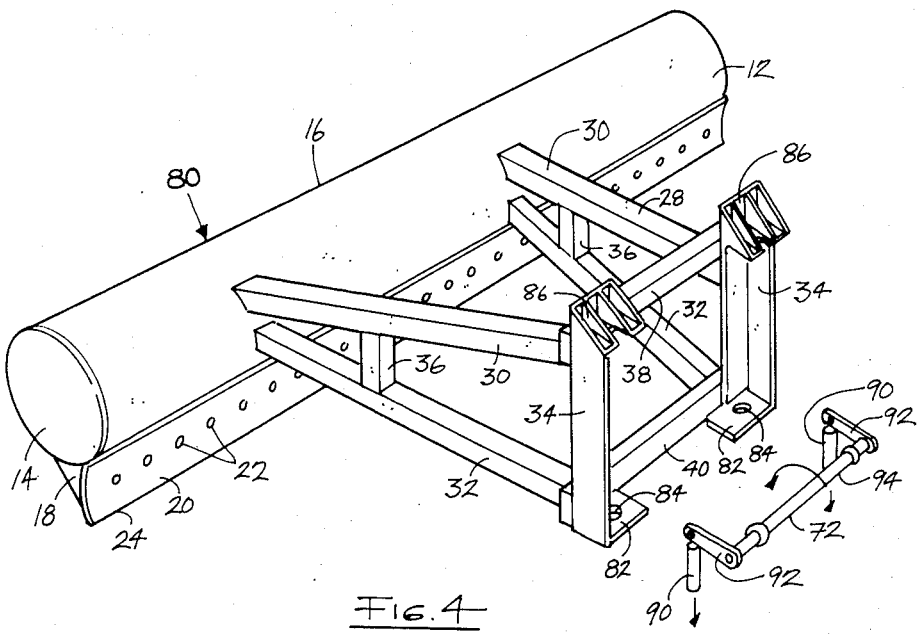
FIG. 4 is an upper perspective view of a second embodiment of a loader attachment in accordance with the present invention also showing part of a quick release mechanism of a loader.
Figure 5:
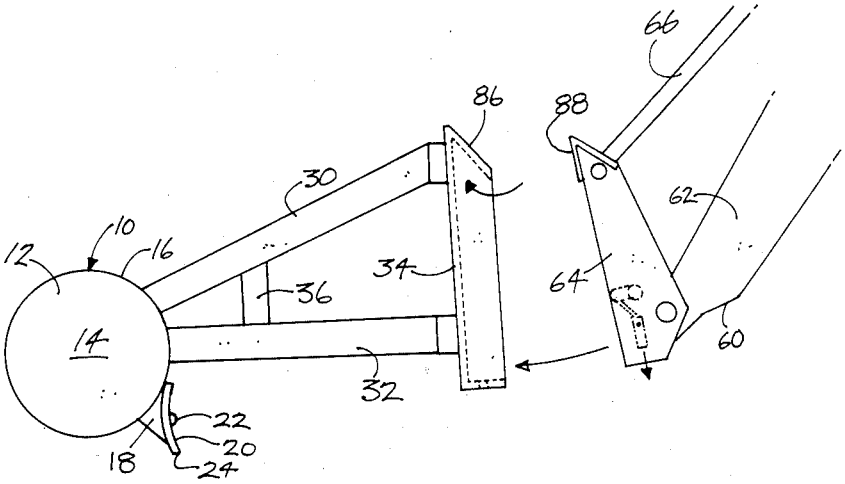
FIG. 5 is a side elevation of the attachment of FIG. 4 also showing a part of a blade arranged to engage with the attachment of FIG. 4.
Figure 6:
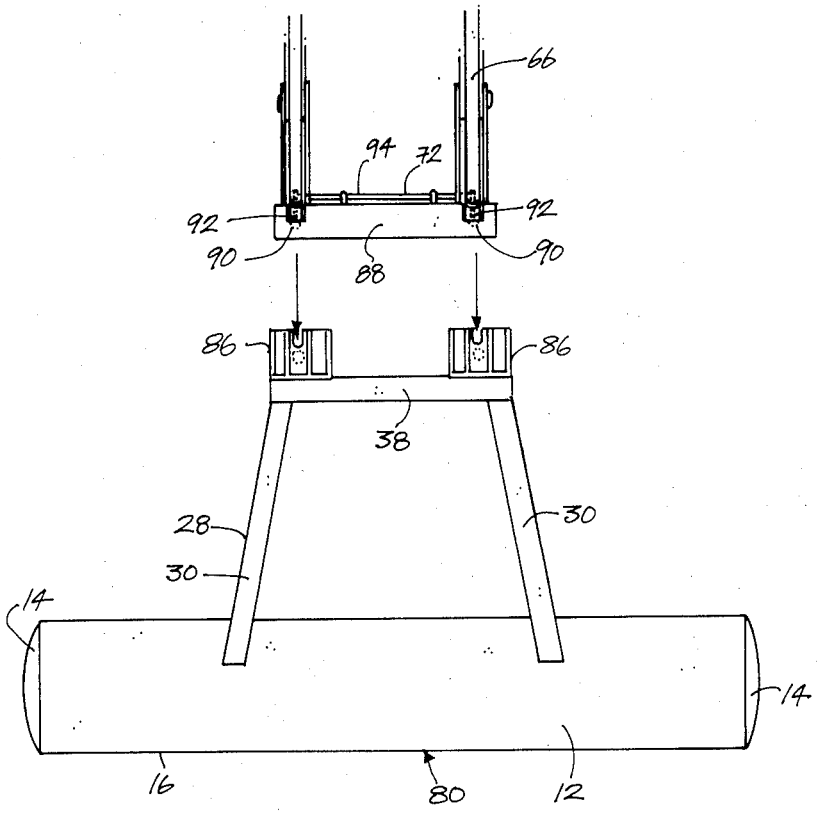
FIG. 6 is a plan view of the arrangement shown in FIG. 5.

In FIGS. 4 to 6, of the accompanying drawings, there is shown an attachment 80 which is similar to the attachment 10 of FIGS. 1 and 2 and like reference numerals denote like parts. The attachment 10 is in principle the same as the attachment 10 but is arranged to be attached to a different type of loader which is known per se.

The significant differences between the attachments 80 and 10 are that in the former the bars 30 and 32 are welded directly to the curved surface 16 of the body member 12.

Further, the posts 34 are angle members. In this case, the posts 34 have mounted in their respective angles at their lower ends outwardly facing plates 82 each containing an eye 84. Further, there are downwardly inclined plates 86 attached to the posts 34 at their upper ends in their respective angles.

Still further, the blade 20 is different in that the strip 68 is replaced by a bifurcated member 88. Also, the quick release mechanism comprises a pair of upright pins 90 which are pivotally connected to respective lugs 92 and respective ends of an axially rotatable rod 94.

The attachment 80 and its loader are releasably connected together in similar manner to the method described in relation to FIGS. 1 to 3, wherein the member 88 is engaged underneath the plates 82 and the adjacent parts of the posts 34 and the plates 64 are then inserted into the angles of the posts 34 until the pins 90 are in alignment with the eyes 84.

Figure 7:
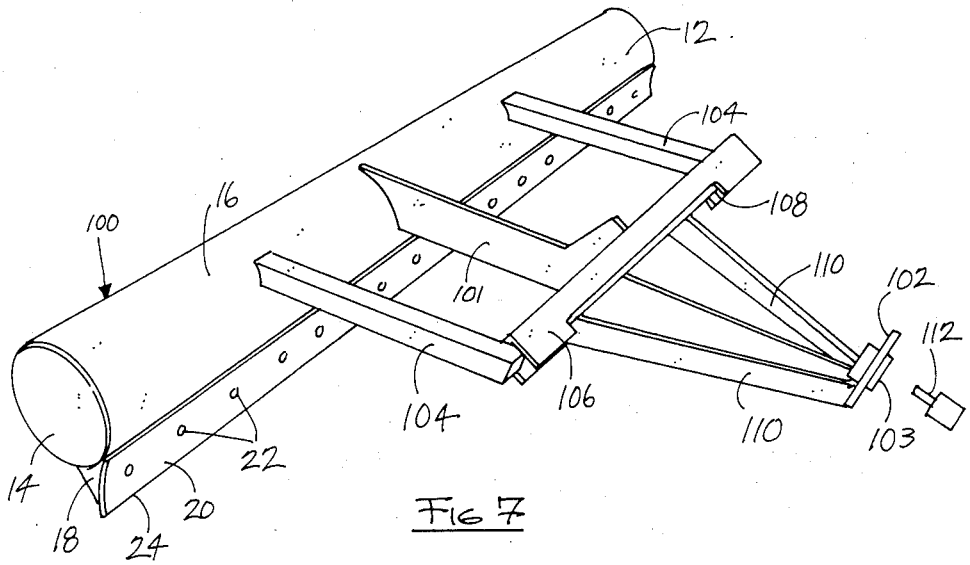
FIG. 7 is an upper perspective view of a third embodiment of a blade attachment in accordance with the present invention also showing part of a quick release mechanism of a loader.
Figure 8:
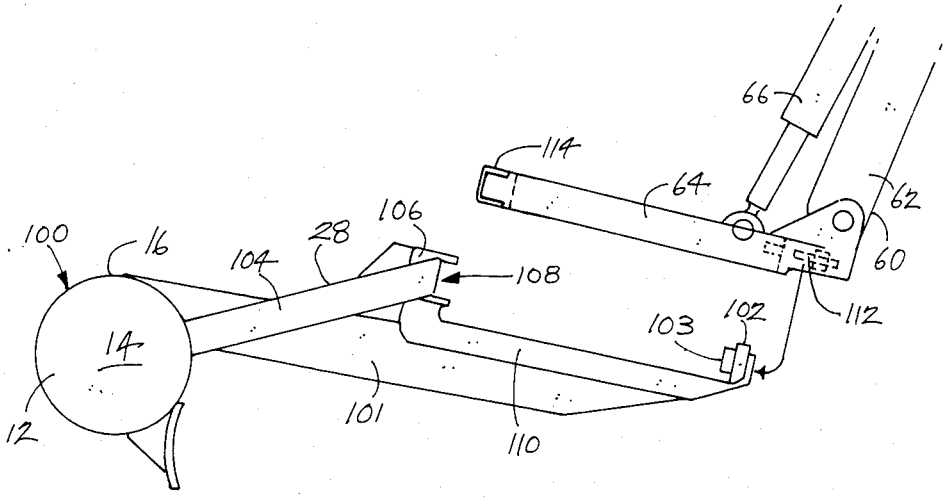
FIG. 8 is a side elevation of the loader attachment of FIG. 5 also showing a loader engagement mechanism arranged to engage with the attachment of FIG. 7.
Figure 9:
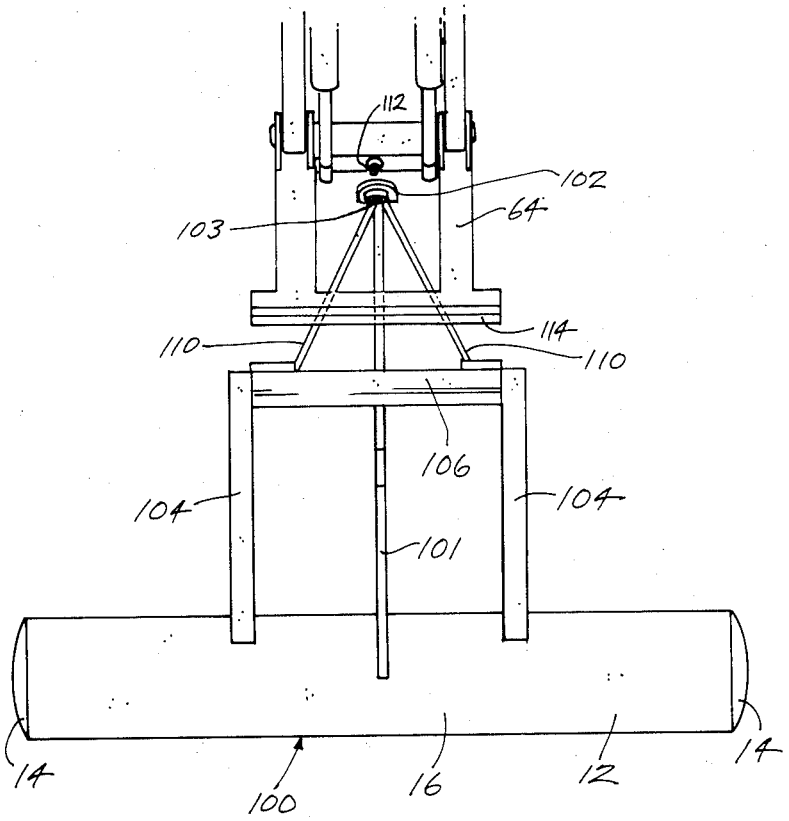
FIG. 9 is a plan view of the arrangement shown in FIG. 8.

The pins 90 are then lowered by rotation of the rod 94 until the pins 90 engage with the eyes 84 so as to connect the loader firmly but releasably to the attachment 80. In FIGS. 7 to 9, of the accompanying drawings there is shown an attachment 100 which is similar to the attachment 10 of FIGS. 1 and 2 and like reference numerals denote like parts. The attachment 100 is in principle the same as the attachment 10 but is arranged to be attached to a different type of loader which is known per se.

The significant differences between the attachments 100 and 10 are that the frame 28 bars are welded directly to the curved surface 16 of the body member 12. Further, the frame 28 comprises a single central bar 101 extending away from the body member 12 to an upstanding lug 102 containing an eye 103. Further, there are lateral bars 104 which extend from the body member 12 on either side of the central bar 101. The bars 104 are of the same length but are shorter than the bar 101.

An intermediate cross bar 106 interconnects the ends of the bars 104 remote from the body member 12. The cross bar 106 contains a longitudinally extending channel shaped recess 108. Further, additional bars 110 extend from the bar 106 to the lug 102.

On the loader, the plates 64 are elongated and the rams 66 are connected to them at intermediate points. Further, the plates 64 are less upwardly inclined than equivalent plates of the other embodiments. The quick release mechanism comprises a single pin 112 which is arranged to be retracted or extended. A cross member 114 interconnects the plates 64 at their free ends remote from the ram 66.

In use, the ram 66 is extended so as to lower the free ends of the plates 64 to enable them and the cross member 114 to engage with the recess 108. Then the ram 66 is retracted to enable the ends of the plates 66 between which the pin 112 is mounted to be lowered so that the eye 103 and the pin 112 come into alignment.

Then the pin 112 is extended so as to firmly but releasably engage the attachment 100 with the loader. Many modifications to the framework 28 can be made so as to adapt the attachment of the present invention to other loaders which are available on the market and known per se. By use of the attachment of the present invention, the driver of a loader can perform two functions with one machine i.e., the job of a loader and the job of a grader.

Figure 10:
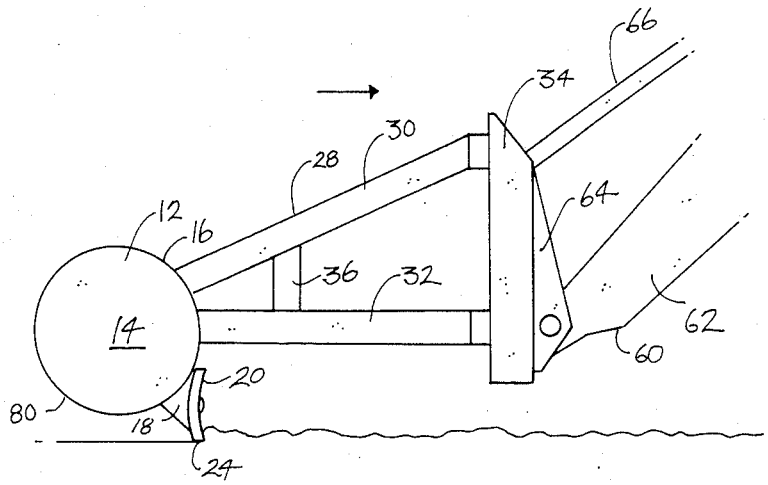
FIG. 10 is a side elevation of a loader engagement mechanism and the attachment of FIGS. 4 and 5 engaged together with the engagement mechanism so orientated that the attachment is in a first position.

With the attachment of the present invention attached to a loader with the frame 28 lowered as shown in FIG. 10, by operation of the engaging mechanism 60 of the loader in known manner, the blade 20 is pointed downwardly and is in a grading position. If the loader is reversed over a tract of ground, the ground is graded by the outer edge 24 of the blade 20.

Figure 11:
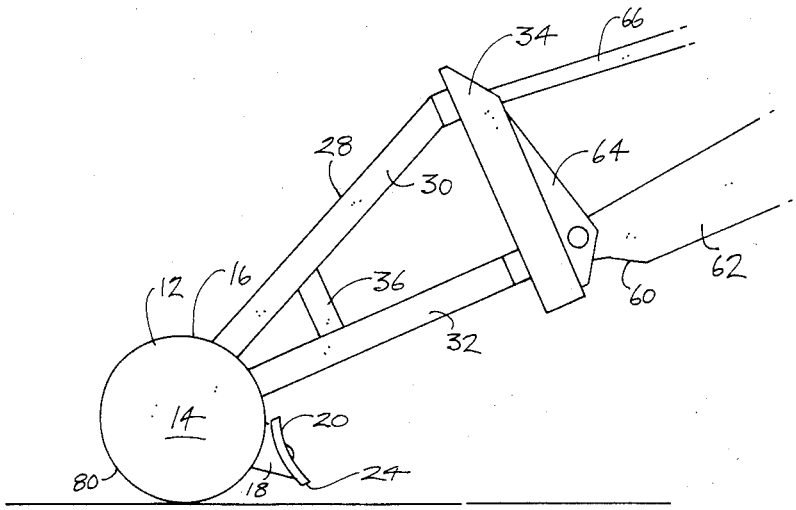
FIG. 11 is a side elevation similar to FIG. 10 except that the engagement mechanism is so orientated that the attachment is in a second position.

In a second position with the frame 28 lifted as shown in FIG. 11 by the engaging mechanism of the loader in a manner known per se, the blade 20 is pointed upwardly somewhat so that the curved cylindrical surface 16 of the body member 12 contacts the ground. In this case as the loader is reversed over a tract of ground, the curved surface 16 smooths ground which has been already levelled by the blade 20.

The fact that a loader can reverse with an attachment of the present invention in position when grading means that no tracks are left behind so that there is no need to level wheel tracks after grading.

The use of the frame 28 has the additional advantages of spacing the attachment from the loader so that the attachment which is often wider than the loader does not foul the wheels or any other part of the loader and the driver can readily observe the operation of the attachment while seated in the driving position.

In addition, all of the advantages of the attachment of U.S. Pat. No. 4,521,980 and Australian Patent Application No. 29587/84 are obtained. Also, the absence of the bucket reduces the overall weight of the loader plus attachment assembly which is particularly advantageous with small machines such as skid steer loaders.

Figure 12:
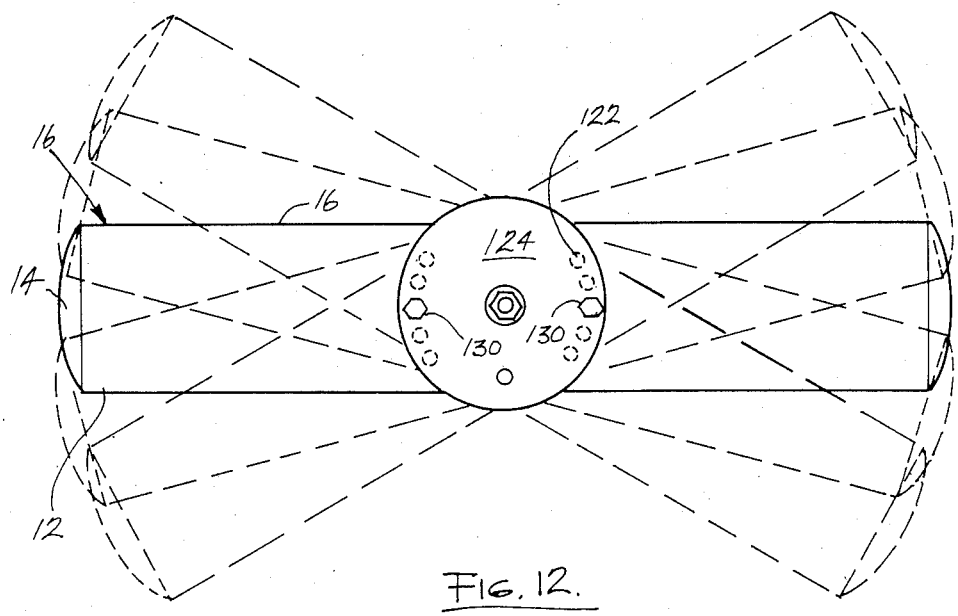
FIG. 12 is a plan view of part of a modified form of loader attachment in accordance with the present invention.
Figure 13:
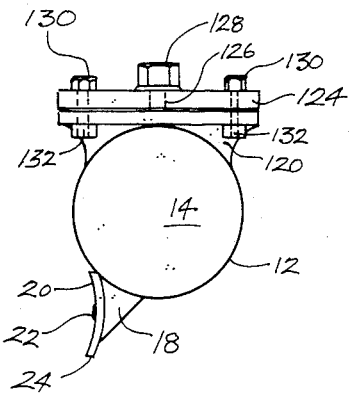
FIG. 13 is a side elevation of the embodiment of FIG. 12 with the attachment angled away from 90° to the direction of travel.

In FIGS. 12 and 13 there is shown a modification of the present invention. The embodiment shown in FIGS. 12 and 13 is similar to that shown in FIGS. 1 to 3 but the modification may be applied to all embodiments of the present invention.

Like reference numerals denote like parts to those found in FIGS. 1 to 3.

However, in this embodiment, the body member 12 has a circular turntable 120 mounted on its upper surface. The turntable 120 contains a plurality of spaced apertures 122 extending in two opposed arcs around part of the principles of the turntable 120. A flat disc member 124 is arranged to mate with the turntable 120. In this connection, the disc member 124 has a central aperture that fits over a stud 126 which projects upwardly from the turntable 120 so that the disc member 124 can be rotated relative to the turntable 120. The disc member 124 is retained in place by a nut 128 threadedly engaged with the stud 126. The disc member 124 contains a pair of apertures which are located diametrically opposite one another.

The disc member 124 is connected to a frame 28 such as by welding.

The disc member 124 is secured in position by means of threaded bolts 130 passed through the apertures of the disc member 124 and opposed pairs of apertures in the turntable 120 and secured by nuts 132.

As shown in solid lines in FIG. 12, the attachment 10 can be orientated at right angles of the direction of travel or it can be orientated at 15° from the right angle position or at 30° from the right angle position by engaging the bolts 130 with the required pair of holes in the turntable 120.

Further, the angle can be adjusted at any time as required. By the use of an angle of 15° or 30° to the right angle it is found that it is easier to deposit dirt to one side only so that there is only a single ridge of residual dirt.

This is especially useful when grading. It is envisaged that the 15° angle would be used in soft ground such as sand whilst the 30° angle would be used in firmer ground such as clay or gravel.

Modifications and variations such as would be apparent to a skilled addressee are deemed within the scope of the present invention.

I claim:

1. An attachment for a loader, wherein the attachment comprises an elongated body member generally in the form of a cylinder having a curved outer surface, a blade extending laterally of the elongated body member and projecting outwardly therefrom, and frame means having a first end and a second end, said first and second ends being spaced apart from one another, the first end of the frame means being attached to the curved surface of the elongated body member, and the second end of the frame means being provided with connection means including at least one recessed member and at least one eye to enable the attachment to be engaged with and disengaged from a quick release mechanism carried by a loader, said blade being disposed relative to the loader such that when the loader is orientated in a first position the blade is arranged to engage with the ground upon movement of the loader and when the loader is orientated in a second position the curved outer surface of the body member is arranged to engage with the ground and to smooth the ground upon movement of the loader.

2. An attachment for a loader according to claim 1, in which the second end of the frame means is provided with a pair of upper recessed members and a pair of lower lugs with respective eyes.

3. An attachment for a loader according to claim 1 in which the frame means comprises two pairs of upper and lower bars extending between the first and second ends of the frame means which bars are interconnected at the second ends of the frame means.

4. An attachment for a loader according to claim 2, in which the recesses are formed in hooks and the eyes are formed in upright plates such that the eyes are laterally facing.

5. An attachment for a loader according to claim 2 in which the recesses are generally of inverted V-shape and the eyes are formed in generally level plates such that the eyes are upwardly facing.

6. An attachment for a loader according to claim 1, in which the second end of the frame means is provided with a single eye and the recess is a single laterally extending channel shaped recess located intermediate the first and second ends of the frame means.

7. An attachment for a loader according to claim 6, in which the frame means comprises a central bar extending between the first and second ends, a pair of lateral shorter bars on respective sides of the central bar, a lateral member with a channel shaped recess interconnecting the lateral bars at their ends remote from the body member and further bars extend from the lateral members to the central member at the second end of the frame means.

8. An attachment for a loader according to claim 1, which includes means for altering the orientation of the body member relative to the frame means.

* * * * *